US008884934B2

(12) United States Patent
Jeon et al.

(10) Patent No.: US 8,884,934 B2
(45) Date of Patent: Nov. 11, 2014

(54) DISPLAY DRIVING SYSTEM USING SINGLE LEVEL DATA TRANSMISSION WITH EMBEDDED CLOCK SIGNAL

(75) Inventors: Hyun-Kyu Jeon, Daejeon-si (KR); Yong-Hwan Moon, Incheon-si (KR)

(73) Assignee: Silicon Works Co., Ltd., Daejeon-Si (KR)

( * ) Notice: Subject to any disclaimer, the term of this patent is extended or adjusted under 35 U.S.C. 154(b) by 833 days.

(21) Appl. No.: 12/873,807

(22) Filed: Sep. 1, 2010

(65) Prior Publication Data

US 2011/0242066 A1 Oct. 6, 2011

(30) Foreign Application Priority Data

Apr. 5, 2010 (KR) ..... 10-2010-0031079

(51) Int. Cl.
*G09G 5/00* (2006.01)
*G09G 3/20* (2006.01)

(52) U.S. Cl.
CPC ..... *G09G 3/20* (2013.01); *G09G 2310/0275* (2013.01); *G09G 2330/06* (2013.01); *G09G 2370/08* (2013.01)
USPC ..... 345/204; 345/98

(58) Field of Classification Search
USPC ..... 345/204, 98, 99, 100
See application file for complete search history.

(56) References Cited

U.S. PATENT DOCUMENTS

| | | | | |
|---|---|---|---|---|
| 2010/0148892 | A1* | 6/2010 | Tsutsumi et al. | 333/254 |
| 2011/0025655 | A1* | 2/2011 | Nishimura et al. | 345/204 |
| 2012/0200542 | A1* | 8/2012 | Hong et al. | 345/204 |

FOREIGN PATENT DOCUMENTS

| | | |
|---|---|---|
| CN | 1653767 | 8/2005 |
| CN | 101273394 | 9/2008 |
| CN | 101477779 | 7/2009 |
| KR | 10-2010-0043452 A | 4/2010 |
| WO | 2007108574 | 9/2007 |

* cited by examiner

*Primary Examiner* — Dwayne Bost
*Assistant Examiner* — Robert Michaud
(74) *Attorney, Agent, or Firm* — Kile Park Reed & Houtteman PLLC

(57) ABSTRACT

A display driving system using single level data transmission with embedded clock signals. The display driving system is configured to embed a clock signal of the same level between data signals and transmit these signals as a single level signal, wherein a cycle at which clock signals are embedded is controlled and a data format is constructed such that a control data transmission step can be extended over 2 words.

19 Claims, 7 Drawing Sheets

DISPLAY DRIVING SYSTEM USING SINGLE LEVEL DATA TRANSMISSION WITH EMBEDDED CLOCK SIGNAL

BACKGROUND OF THE INVENTION

1. Field of the Invention

The present invention relates to a display driving system, and more particularly, to a display driving system using single level data transmission with embedded clock signals, which is configured to embed a clock signal of the same level between data signals and transmit these signals as a single level signal, wherein a cycle at which clock signals are embedded is controlled and a data format is constructed such that a control data transmission step can be extended over 2 words.

2. Description of the Related Art

These days, as the digital home appliance market is grown and the distribution of personal computers and portable communication terminals is increased, display devices as final output devices of home appliances and communication terminals are required to be light in weight and consume a small amount of power. Techniques for meeting these requirements are continuously proposed in the art. Accordingly, flat display devices, such as an LCD (liquid crystal display), a PDP (plasma display panel) and an OELD (organic electro-luminescence display), which replace the conventional CRT (cathode ray tube), have been developed and are being distributed.

Each of the flat display devices includes a timing controller which processes RGB data and generates a timing control signal so as to drive a panel used for displaying received RGB data, and column driving units and row driving units which drive the panel using the RGB data and the timing control signal transmitted from the timing controller.

In particular, recently, differential signal transmission schemes capable of reducing electromagnetic interference (EMI) and transmitting data at a high speed, such as mini-LVDS (low voltage differential signaling) and RSDS (reduced swing differential signaling), have been increasingly used.

FIG. 1 is a view illustrating transmission of data differential signals and clock differential signals in conventional LVDS, and FIG. 2 is a view illustrating transmission of data differential signals and clock differential signals in conventional RSDS.

Referring to FIGS. 1 and 2, the recently used mini-LVDS or RSDS has at least one data differential signal line which is connected to a timing controller 10 so as to support a desired bandwidth and a separate clock differential signal line which is configured to output a clock differential signal in synchronism with a data differential signal, and adopts a multi-drop scheme in which respective column driving units 20 share the data differential signal line and the clock differential signal line.

While the multi-drop scheme has advantages in that the timing controller 10 can be used irrespective of the number of outputs depending upon a resolution, that is, the number of the column driving units 20, it encounters a problem in that signal distortion by reflection waves is caused and electromagnetic interference (EMI) increases due to impedance mismatch occurring at points where the data differential signal and the clock differential signal are supplied to the respective column driving units 20, and in that an operation speed is limited due to a large load applied to the clock differential signal.

In order to overcome the problem caused in the multi-drop scheme, PPDS (point-to-point differential signaling), in which data differential signals are separately supplied to respective column driving units and a clock differential signal is shared by the column driving units, has been proposed in the art.

FIG. 3 is a view illustrating transmission of data differential signals through independent data signal lines in conventional PPDS, and FIG. 4 is a view illustrating chain type transmission of clock differential signals in another conventional PPDS.

Referring to FIG. 3, in PPDS, an independent data line is formed between a timing controller 10 and each column driving unit 20 so that data differential signals are separately supplied to respective column driving units 20. Therefore, impedance mismatch, electromagnetic interference (EMI) and overloading of a clock differential signal that can otherwise be caused in the multi-drop scheme can be overcome.

In the PPDS, the clock differential signal should be transmitted at a high speed. In this regard, because the PPDS shown in FIG. 3 is configured to share the clock differential signal, an operation speed is limited when a load applied to the clock differential signal is substantial. Hence, as shown in FIG. 4, a signal transmission scheme is used, in which a clock differential signal is supplied to the respective column driving units 20 in a chain type. In this case, a problem is caused in that sampling of data is not properly implemented due to clock delay occurring between the column driving units 20.

Further, as display devices trend toward a large screen size and a high resolution and the number of column driving units increases accordingly, the PPDS scheme encounters a problem in that the numbers of data and clock signal lines increase at the same rate, connection of entire signal lines is complicated, and a high manufacturing cost results.

FIG. 5 is a view illustrating a conventional AiPi (advanced intra-panel interface).

Referring to FIG. 5, the AiPi has recently been suggested in which data and clock signals are distinguished by multi-levels and data differential signals with clock signals embedded therebetween are transmitted from a timing controller to column driving units through independent respective signal lines. Therefore, the number of signal lines can be significantly decreased, and electromagnetic interference (EMI) is reduced. Also, since the operation speed and the resolution of a panel are increased despite the decrease in the number of signal lines, it is possible to solve the problems caused by skew or jitter occurring between the data and clock signals while transmitting signals at a high speed.

In the recently proposed AiPi transmission scheme, while signals are transmitted by embedding clock signals between data to decrease the number of signal lines and prevent the occurrence of skew between the data and clock signals, since the embedded clock signals are transmitted to constitute multi-level signals by having a level higher or lower than data signals, problems are caused in that it is impossible to minimize the level of signals to be transmitted and reduction of electromagnetic interference (EMI) is poor.

As a consequence, an interface for transmitting data at a high speed between a timing controller and column driving units, which can decrease the number of signal lines for transmitting data differential signals and clock differential signals, minimize electromagnetic interference (EMI), and prevent the occurrence of skew and jitter between signal lines, is keenly demanded in the art.

In order to meet the demand, the present applicant has disclosed a display driving system using single level signaling with embedded clock signals in Korean Patent Application No. 2008-102492 filed on Oct. 20, 2008, wherein a clock signal of the same level is embedded between data signals in a timing controller and is transmitted through an independent data signal line to each panel driving unit in the type of a single level signal, and the clock signal is recovered in the panel driving unit, data is sampled and RGB data is outputted to a panel, so that a data transmission speed can be maximized and the level of signals to be transmitted and the frequency of the embedded clock signal can be minimized.

However, while a cycle at which a clock signal is embedded is associated with RGB data, influence by internal interference increases as the bit depth of the RGB data or a transmission rate increases, by which the jitter of an input signal increases. As a consequence, it becomes difficult to compare the phase of a clock signal which is recovered by a clock recovery circuit of a data receiving section and the phase of a clock signal which is embedded in data.

In a control data transmission period (a configuration period) between a clock training period and a data period, control data corresponding to a maximum RGB data size can be transmitted. In this regard, in the case where the cycle at which the clock signal is embedded is smaller than the data size or the control data larger than the data size should be transmitted, limitations exist in implementing configuration.

SUMMARY OF THE INVENTION

Accordingly, the present invention has been made in an effort to solve the problems occurring in the related art, and an object of the present invention is to provide a display driving system using single level data transmission with embedded clock signals, which is configured to embed a clock signal of the same level between data signals and transmit these signals in a single level type, wherein a cycle at which clock signals are embedded is controlled and a data format is constructed such that a control data transmission step to be distinguished by a TR-bit can be extended to at least two words.

Another object of the present invention is to provide a display driving system using single level data transmission with embedded clock signals, in which a clock signal recovered by a data receiving section and a clock signal embedded in data can be easily compared with each other, control data larger than the size of RGB data can be transmitted, and timing for transmitting the control data can be controlled.

In order to achieve the above object, according to one aspect of the present invention, there is provided a display driving system comprising: a timing controller including a receiving unit configured to receive data signals, a data processing unit configured to process and output the data signals, a clock generation unit configured to generate clock signals and timing control signals, and a transmission block configured to transmit the data signals, the clock signals and the timing control signals; and a panel driving block including row driving units configured to sequentially scan gate signals to a display panel, and column driving units configured to receive the data signals transmitted from the transmission block through signal lines and drive the display panel, wherein the transmission block of the timing controller includes driving units configured to embed the clock signals between the data signals at the same level, and generate and output single level transmission data, and wherein the transmission data are transmitted to the column driving units in a manner divided into a clock training data transmission step, a control data transmission step and an RGB data transmission step.

BRIEF DESCRIPTION OF THE DRAWINGS

The above objects, and other features and advantages of the present invention will become more apparent after a reading of the following detailed description taken in conjunction with the drawings, in which.

DETAILED DESCRIPTION OF PREFERRED EMBODIMENTS

Figure 1:
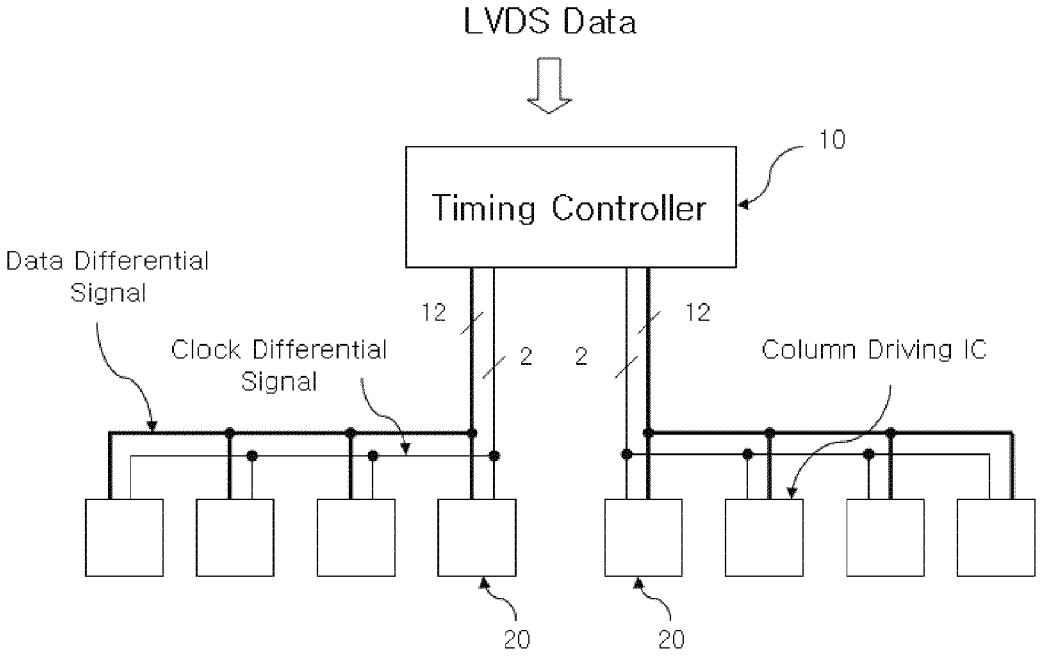
FIG. 1 (PRIOR ART)
FIG. 1 is a view illustrating transmission of data differential signals and clock differential signals in conventional LVDS.
Figure 2:
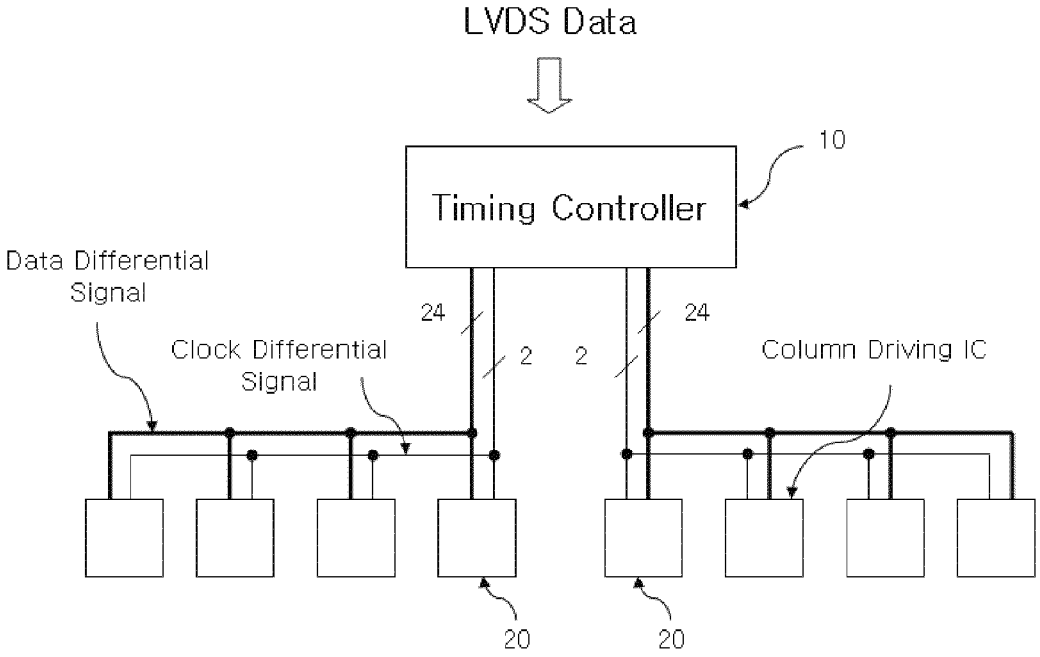
FIG. 2 (PRIOR ART)
FIG. 2 is a view illustrating transmission of data differential signals and clock differential signals in conventional RSDS.
Figure 3:
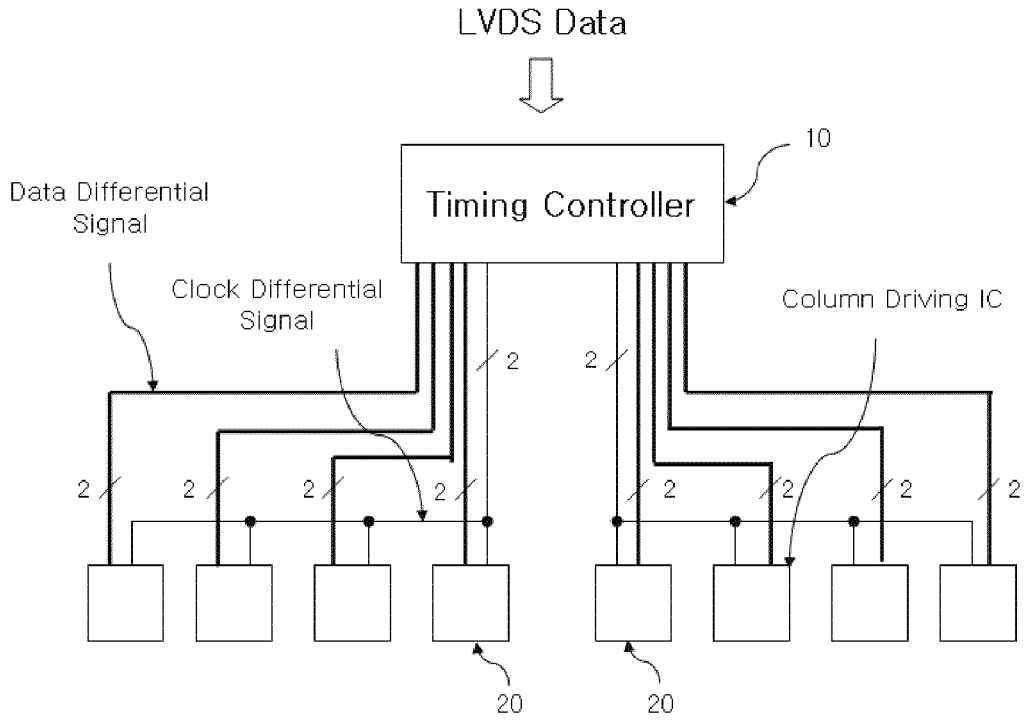
FIG. 3 (PRIOR ART)
FIG. 3 is a view illustrating transmission of data differential signals through independent data signal lines in another conventional PPDS.
Figure 4:
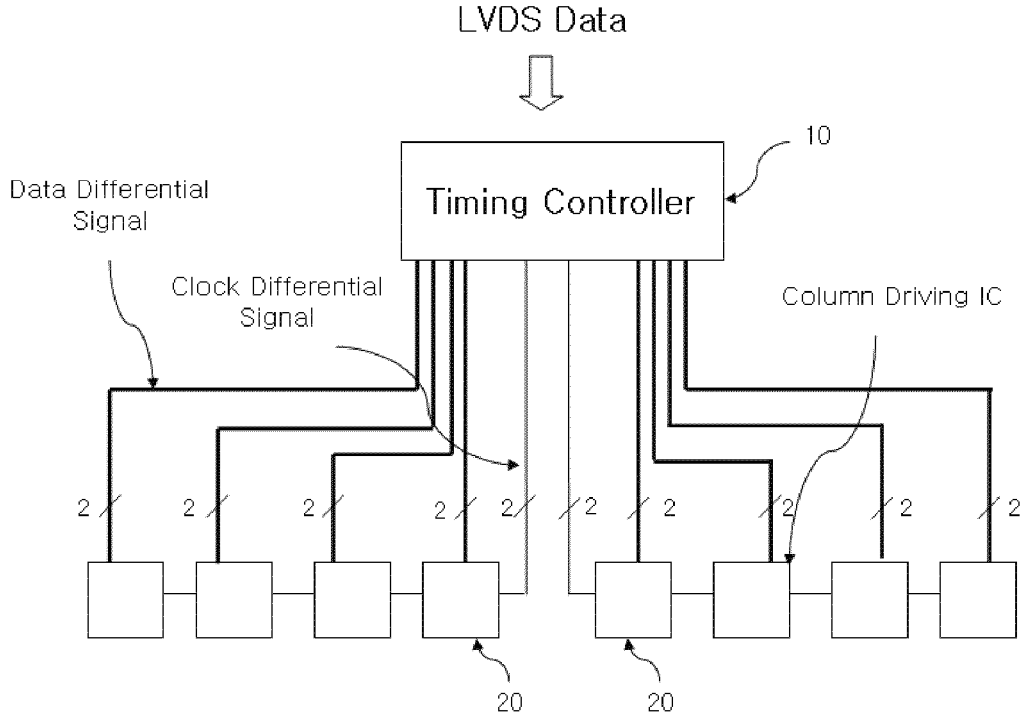
FIG. 4 (PRIOR ART)
FIG. 4 is a view illustrating chain type transmission of clock differential signals in conventional PPDS.
Figure 5:
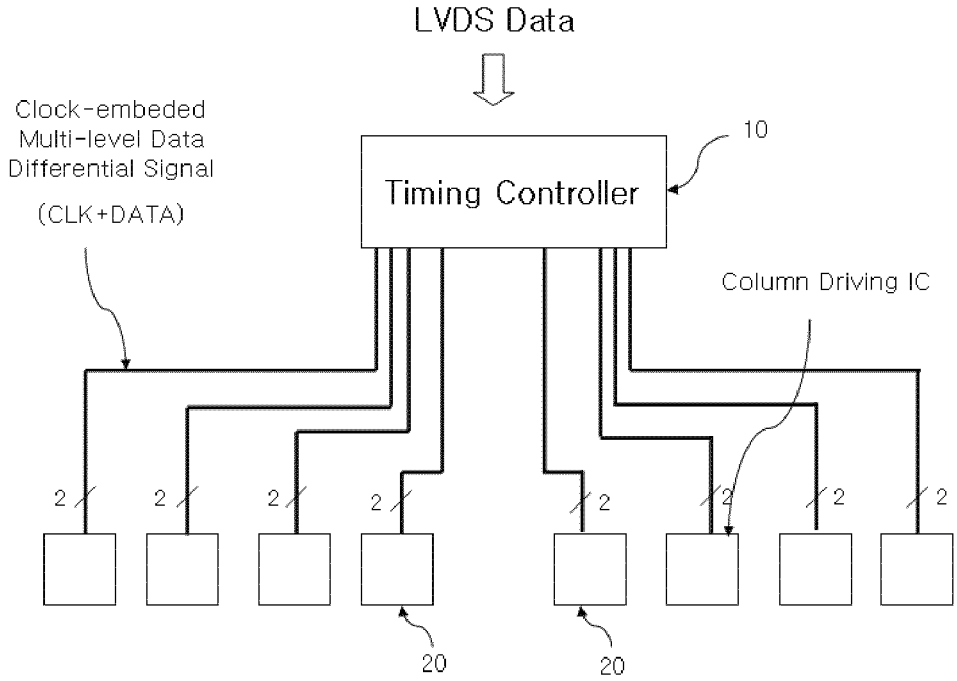
FIG. 5 (PRIOR ART)
FIG. 5 is a view illustrating a conventional AiPi.

Reference will now be made in greater detail to preferred embodiments of the invention, examples of which are illustrated in the accompanying drawings. Wherever possible, the same reference numerals will be used throughout the drawings and the description to refer to the same or like parts.

Figure 6:
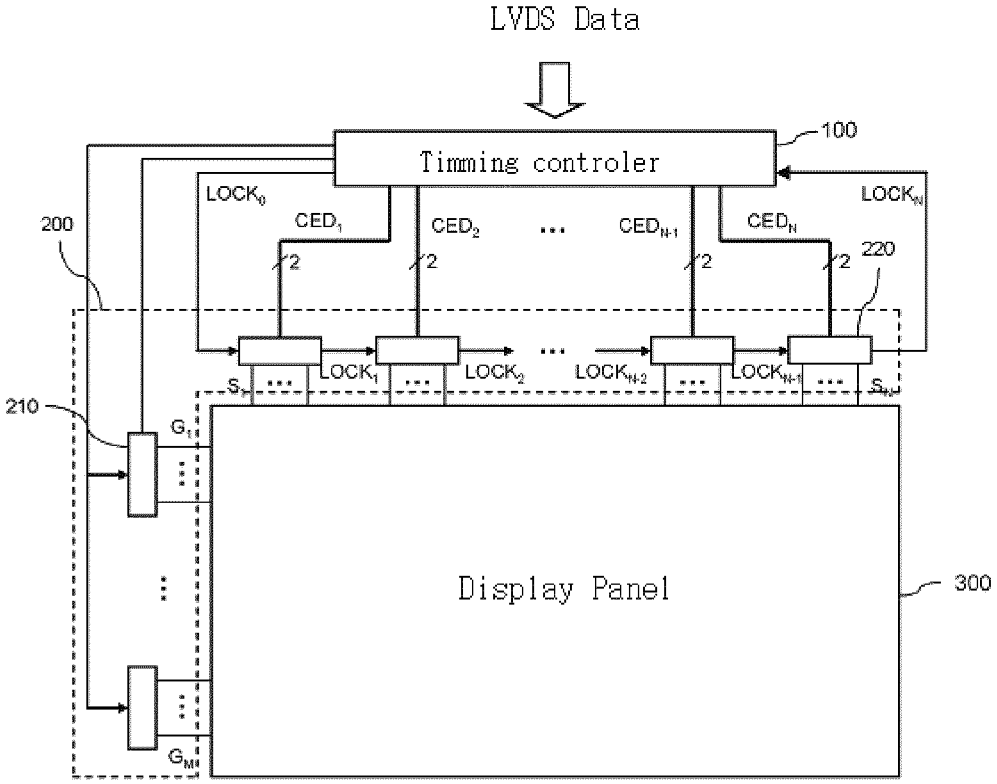
FIG. 6 is a view illustrating the configuration of a display driving system using single level data transmission with embedded clock signals according to the present invention.
Figure 7:
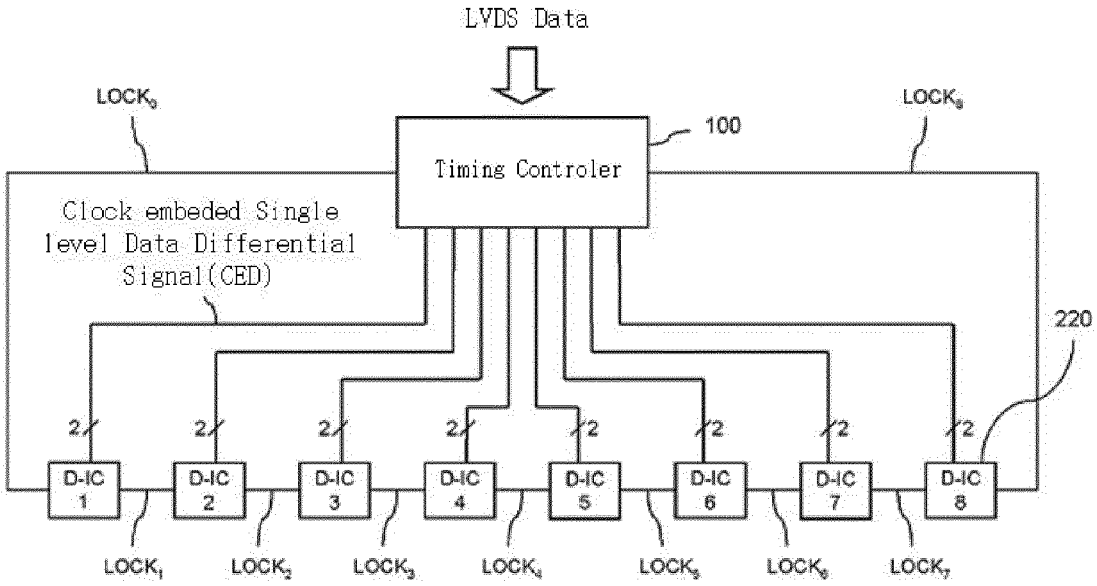
FIG. 7 is a schematic view illustrating a state in which data composed of single level clock signal and data signal is transmitted through a single signal line according to the present invention.

FIG. 6 is a view illustrating the configuration of a display driving system using single level data transmission with embedded clock signals according to the present invention, and FIG. 7 is a schematic view illustrating a state in which data composed of single level clock signal and data signal is transmitted through a single signal line according to the present invention.

Referring to FIGS. 6 and 7, a display driving system using single level data transmission with embedded clock signals in accordance with an embodiment of the present invention includes a timing controller 100 configured to receive LVDS data signals, embed each of clock signals between the data signals in such a way as to have the same level and transmit single level transmission data, and a panel driving block 200 configured to receive the transmission data, distinguish and sample clock signals and data signals using received clock signals which are recovered during a clock training data transmission step and transmit these signals to a display panel 300.

The panel driving block 200 is composed of row driving units 210 which sequentially emit gate signals $G_1$ through $G_M$ to the display panel 300 and column driving units 220 which supply source signals $S_1$ through $S_N$ to be displayed.

The timing controller 100 transmits only a CED (clock-embedded data) signal as a differential pair, in which a clock signal is embedded at the same level between data signals, to each column driving unit 220 of the panel driving block 200 via one signal line.

The column driving unit 220 functions to internally recover the clock signal inputted thereto from the CED signal. When the recovered clock signal is initially unstable, a LOCK signal is outputted in a logic low state, and when the recovered clock signal becomes stable, the LOCK signal is outputted in a logic high state. The column driving unit 220 receives a LOCK signal from an adjacent column driving unit 220, combines the received LOCK signal with its internal LOCK signal by using a separate logic element, and outputs a LOCK signal to an outside. Accordingly, LOCK signals $LOCK_1$~$LOCK_7$, which are outputted from respective column driving units 220, are sequentially transferred to adjacent column driving units 220, and a LOCK signal $LOCK_8$ is finally transferred to the timing controller 100. In this way, the timing controller 100 can receive the information of the LOCK signals outputted from all the column driving units 220 which are connected thereto.

Meanwhile, it is conceivable that LOCK signals $LOCK_1$~$LOCK_{N-1}$ of respective column driving units 220 can be individually transferred to the timing controller 100 instead of being sequentially transferred to adjacent column driving units 220 as shown in FIGS. 6 and 7.

Figure 8:
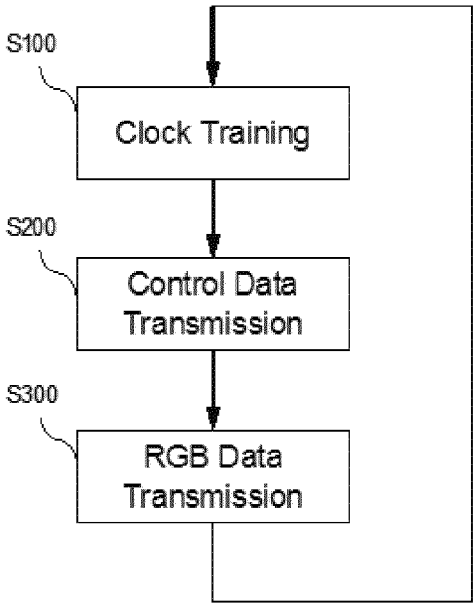
FIG. 8 is an exemplary view illustrating a protocol scheme of a CED signal in which a clock signal is embedded between data signals at the same level.
Figure 9:
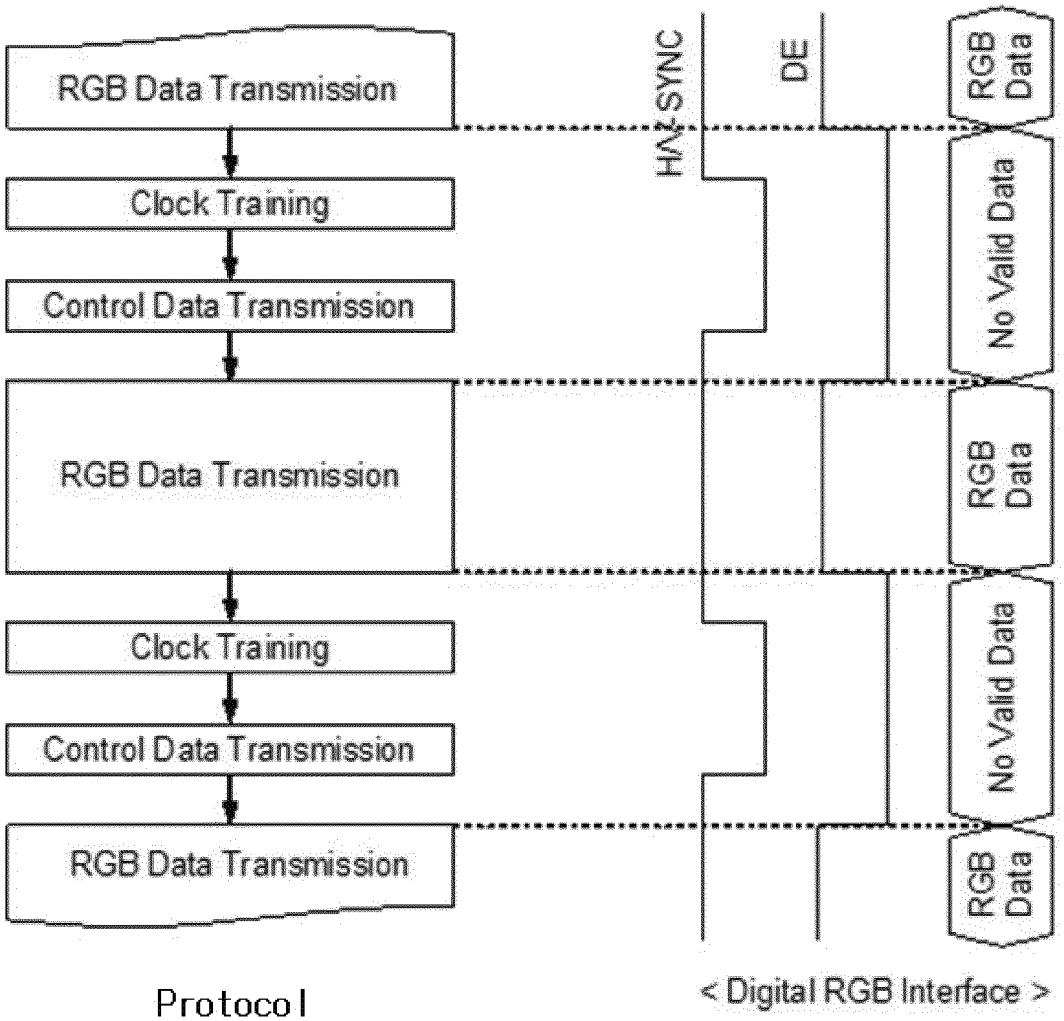
FIG. 9 is an exemplary view illustrating a relationship between a protocol of the CED signal in which a clock signal is embedded between data signals at the same level and an existing digital RGB interface.

Referring to FIGS. 8 and 9, a protocol, which adopts the data transmission scheme with embedded clock signals according to the present invention, includes a clock training data transmission step S100, a control data transmission step S200, and an RGB data transmission step S300.

In the clock training data transmission step S100, the timing controller 100 transmits the data configured in the form of clocks, and the column driving units 220 implement synchronization of the data with respect to internally recovered clock signals. While transmitting clock training data, the timing controller 100 continuously monitors whether or not the clock signals recovered by the column driving units 220 are stabilized, through the LOCK signal $LOCK_8$. If the LOCK signal $LOCK_8$ is inputted in the logic high state, the clock training data transmission step S100 is ended after a predetermined time elapses, and a state transits to the control data transmission step S200.

In the control data transmission step S200, the timing controller 100 transmits control data for distinguishing the clock training data and RGB data from each other.

Thereafter, whether or not the control data transmission step S200 is ended is monitored, and the data transmitted after the control data transmission step S200 is ended is unconditionally recognized as RGB data, by which the RGB data transmission step S300 is implemented. Then, if the transmission of the RGB data is completed, the clock training data transmission step S100 is implemented again, and data transmission is continued.

FIG. 9 is a schematic view illustrating a relationship between an existing digital RGB interface and the protocol according to the present invention. The RGB data transmission step S300 is implemented during a period in which a DE (data enable) signal is in a logic high state and valid RGB data are transmitted, and the clock training data transmission step S100 and the control data transmission step S200 are implemented during a period in which the DE signal is in a logic low state and valid RGB data are not transmitted.

The period, in which the DE signal is in the logic low state and the valid RGB data are not transmitted, is divided into a vertical blank period and a horizontal blank period.

The vertical blank period means a period in which valid RGB data are not transmitted where a frame is changed while transmitting RGB data, and the horizontal blank period means a period in which valid RGB data are not transmitted between one scanning line and a next scanning line in one frame while transmitting RGB data. In each period, a vertical synchronization signal VSYNC or a horizontal synchronization signal HSYNC becomes a logic low state. Also, at least one horizontal synchronization signal HSYNC can be included in one vertical synchronization signal VSYNC.

Figure 10:
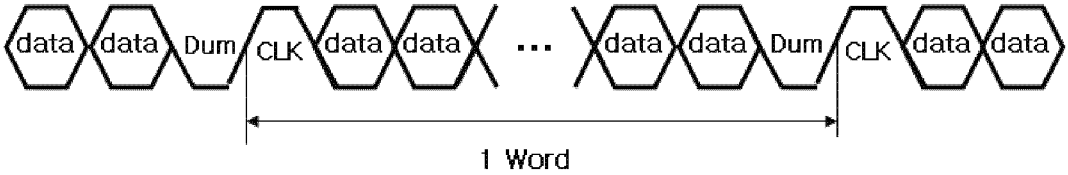
FIG. 10 is an exemplary view showing CED signals in a data transmission step, in which each of clock signals is embedded between data signals at the same level according to the present invention.
Figure 11:
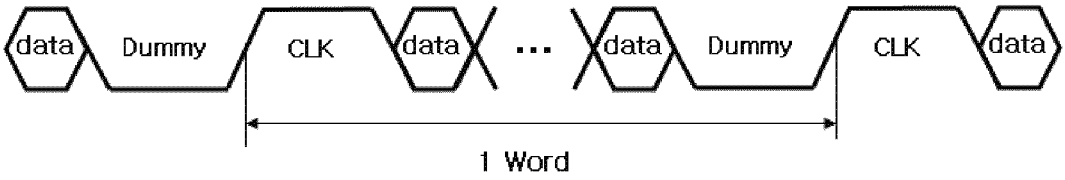
FIG. 11 is another exemplary view showing CED signals in a data transmission step, in which each of clock signals is embedded between data signals at the same level according to the present invention.
Figure 12:
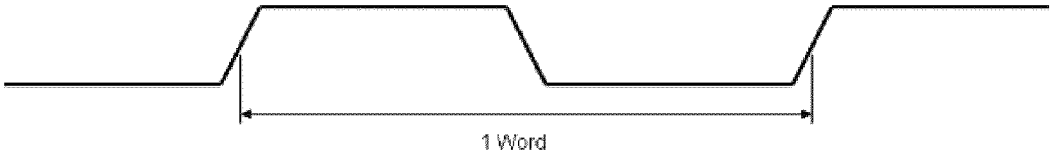
FIG. 12 is an exemplary view showing a CED signal which is transmitted in a clock training data transmission step according to the present invention.

FIGS. 10 and 11 are exemplary views showing data signals which can be used in an interface between the timing controller 100 and the column driving units 220 according to the present invention. The clock training data, the control data and the RGB data are configured in such a manner that a clock signal is inserted between data signals and a dummy signal is inserted between the data signal and the clock signal so as to indicate the transition timing of the inserted clock signal, as shown in FIG. 10. The transition timing of the clock signal may be a rising edge or a falling edge. Further, as shown in FIG. 11, the signal width of the dummy signal and the clock signal can be increased to at least two bits so as to ease circuit design. FIG. 12 is an exemplary view showing a data signal which is transmitted in the clock training data transmission step. The clock training data is configured in such a manner that a clock signal is embedded between data in a pulse width modulation (PWM) type.

Operations of the display driving system of the present invention according to the protocol which adopts the data transmission scheme with embedded clock signals will be described below.

The timing controller 100 first transmits the clock training data before transmitting the RGB data, and thereby, starts the clock training data transmission step. The signal transmitted during the clock training data transmission step is a data signal for easing clock recovery in the data receiving sections of the column driving units 220.

In the control data transmission step, the timing controller 100 transmits the control data for controlling the column driving units 220. In order to distinguish the clock training data transmission step and the control data transmission step, a separate TR-bit is inserted in the control data in which a clock signal is embedded.

In order to transmit control data having a length larger than a cycle at which the clock signal is embedded in data, the length of a control data transmission period can be extended to one word or at least two words by inserting a plurality of TR-bits.

Figure 13:
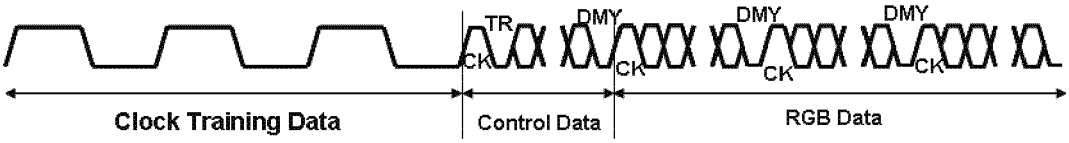
FIG. 13 is a view illustrating an exemplary CED signal which is transmitted according to the protocol of the display driving system which adopts a scheme for transmitting data with an embedded clock signal according to the present invention.

For example, when the control data to be transmitted after the clock training data transmission step is composed of only one word as shown in FIG. 13, if the value of a first data bit (TR-bit), transmitted after a clock signal CK, in the control data is low, recognition is made as control data, and it is recognized that RGB data are inputted from second data after the control data.

Figure 14:
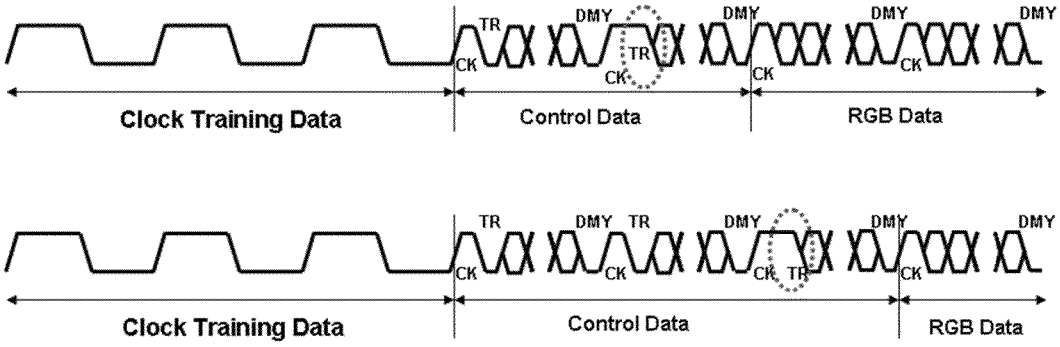
FIG. 14 is a view illustrating a state in which a control data transmission step is extended to transmission of control data of at least two words in the protocol of the display driving system which adopts the scheme for transmitting data with an embedded clock signal according to the present invention.

In the case where the control data is composed of a plurality of words as shown in FIG. 14, a first data bit (TR-bit) of each word, which constitutes the control data transmitted after the clock training data transmission step, is monitored. If the value of the corresponding bit is low, recognition is made as a first word of the control data. Then, by monitoring a first data bit of the control data inputted thereafter, if the value of the corresponding bit is continuously low, recognition is made as a continuous word of the control data. If the value of the corresponding bit is high, recognition is made as a final word of the control data, and it is recognized that a word transmitted thereafter corresponds to RGB data.

If the number of words of the control data transmitted after the clock training data transmission step is fixed, it can be envisaged that, by monitoring a first data bit of each word which constitutes the control data, words of the control data can be recognized by a predetermined number, and words transmitted thereafter can be recognized as RGB data.

That is to say, in order to distinguish the clock training data and the control data, the value of a first data bit (TR-bit) which is inserted in a first word of the control data can be set to a predetermined value, and thereby, whether or not the clock training data transmission step is ended can be determined. Also, in order to distinguish the control data and the RGB data, the value of a first data bit of a final word among a plurality of words which constitute the control data can be set to a preselected value, and thereby, whether or not the control data transmission step is ended can be determined. Thereafter, it can be recognized that the RGB data transmission step is started. The data bit (TR-bit) for distinguishing the respective steps can be configured as a data pattern which is preset by at least one data bit.

In the RGB data transmission step, the RGB data which are to be displayed in an RGB type are transmitted. In the RGB data, a clock signal can be embedded in each RGB pixel data or in each sub-pixel data constituting an RGB pixel, depending upon a cycle at which the clock signal is embedded in data. A clock signal may be embedded regardless of an RGB pixel configuration.

When the transmission of the RGB data is ended and clock training is started again, the data receiving section counts the number of the RGB data using a counter circuit so as to determine whether a signal corresponds to the RGB data or the clock training data. In other words, the data receiving section counts the number of the received clock signals which are used in sampling of each data or the number of the clock signals which are embedded in the RGB data, and thereby, checks the number of data. In this way, whether an RGB data transmission period is ended and the clock training data transmission step is newly started is monitored. Therefore, a separate transmission step or a separate signal for the distinguishment is not needed.

Figure 15:
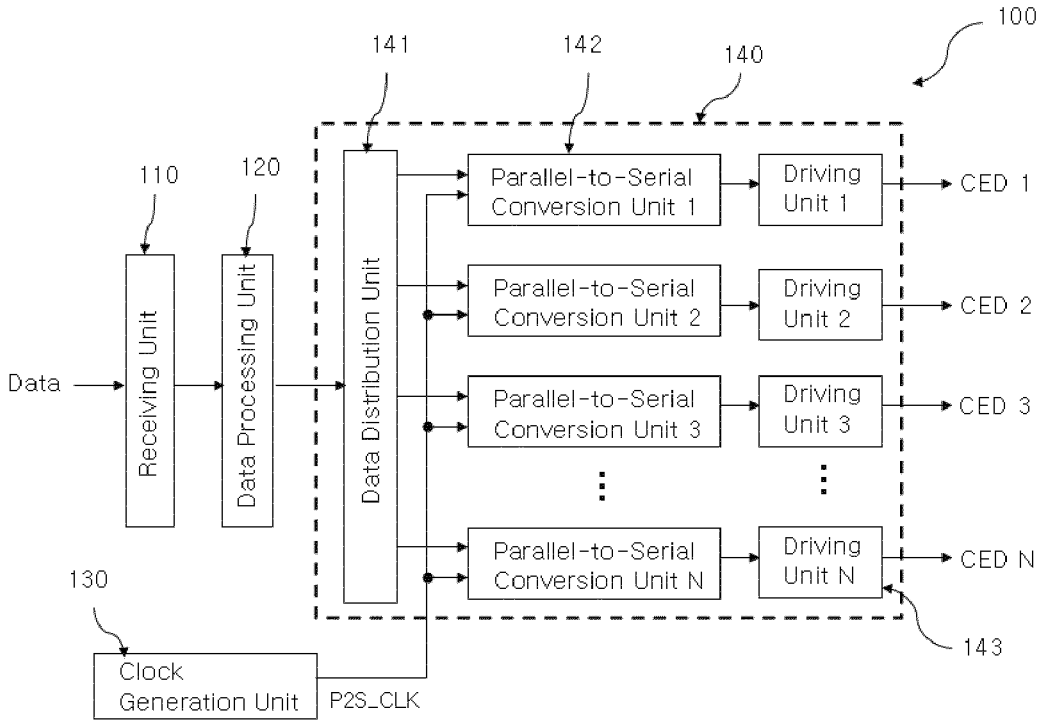
FIG. 15 is a view illustrating a timing controller in the display driving system which adopts the scheme for transmitting data with an embedded clock signal according to the present invention.

FIG. 15 illustrates the configuration of a timing controller 100. The timing controller 100 includes a receiving unit 110 configured to receive RGB data to be displayed, a data processing unit 120 configured to temporarily store the received RGB data and output clock-embedded data, such as the clock training data, the control data and the RGB data, depending upon a protocol, a clock generation unit 130 configured to generate a serialized clock signal P2S_CLK necessary for serializing the data by the transmission steps, such as the clock training data, the control data and the RGB data, depending upon the protocol, and a transmission block 140 configured to receive the clock-embedded data which are outputted from the data processing unit 120, serialize the clock-embedded data in conformity with the serialized clock signals outputted from the clock generation unit 130 and transmit the serialized data.

The transmission block 140 includes a data distribution unit 141 configured to receive the data signals with embedded clock signals which are outputted from the data processing unit 120, that is, the clock training data, the control data and the RGB data, and distribute data to be transmitted to the respective column driving units 220, parallel-to-serial conversion units 142 configured to convert the data distributed from the data distribution unit 141 into serial data by using the serialized clock signals generated in the clock generation unit 130, and driving units 143 configured to transmit clock-embedded transmission data CED to the respective column driving units 220.

The timing controller 100 transfers the transmission data including the data signals serialized in the parallel-to-serial conversion units 142 to the panel driving block 200 which includes one or more column driving units 220.

Figure 16:
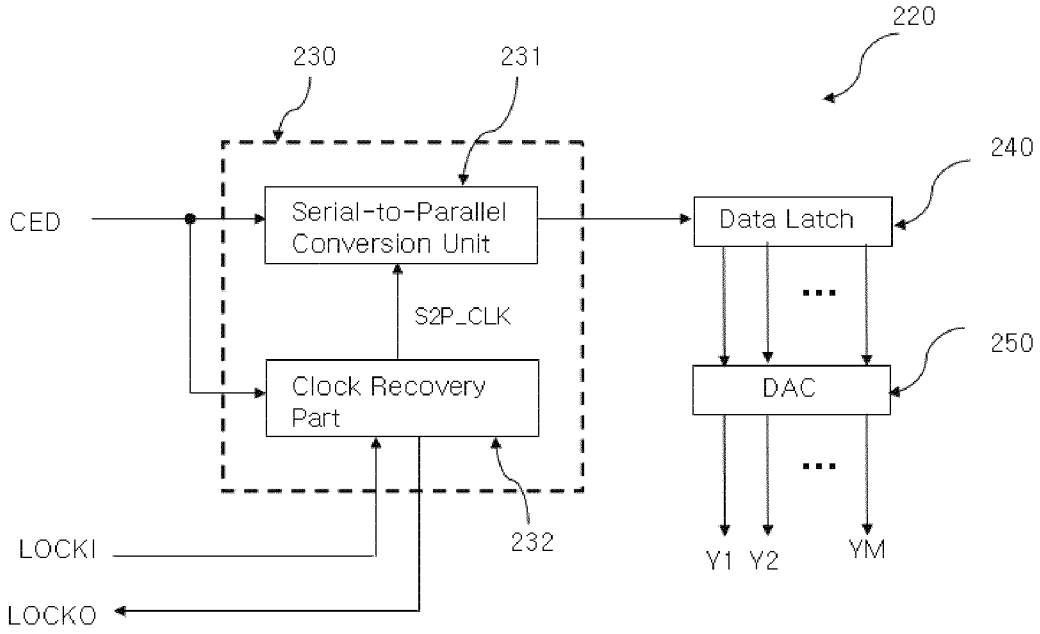
FIG. 16 is a view illustrating a column driving unit in the display driving system which adopts the scheme for transmitting data with an embedded clock signal according to the present invention.

FIG. 16 is a view illustrating the configuration of the column driving unit 220.

Referring to FIG. 16, the column driving unit 220 includes a data receiving section 230 configured to receive the data transmitted from the timing controller 100, a data latch 240 configured to sequentially store RGB data depending upon the control information included in the control data received from the data receiving section 230, and a digital-to-analog converter 250 configured to drive a panel according to the values of the RGB data stored in the data latch 240.

The data receiving section 230 includes a clock recovery part 232 configured to recover embedded clock signals from the clock-embedded data which are transmitted from the timing controller 100, and a serial-to-parallel conversion part 231 configured to sample control data and RGB data by using received clock signals S2P_CLK which are recovered by the clock recovery part 232.

The clock recovery part 232 recovers the embedded clock signals and generates the received clock signals S2P_CLK by using a delay locked loop (DLL) or a phase locked loop (PLL). The clock recovery part 232 recovers the received clock signals to be used for data sampling, depending upon the CED signals transmitted during the clock training data transmission step after a signal LOCKI inputted from the timing controller 100 or another column driving unit 220 in the panel driving block 200 becomes a logic high state, and outputs a signal LOCKO in a logic high state when the received clock signals are stabilized.

As is apparent from the above description, the display driving system using single level data transmission with embedded clock signals according to the present invention provides advantages in that a cycle, at which clock signals are embedded, is controlled regardless of the bit size of RGB data so that the phase of a clock signal recovered by a data receiving section and the phase of a clock signal embedded in data can be easily compared with each other, a configuration as a control data transmission period, which is distinguished by a TR-bit, can be extended to at least two words so that control data larger than the size of the RGB data can be freely transmitted, and a transmission timing of specified control data can be controlled.

Also, in the present invention, a signal for checking whether a column driving unit can receive data is outputted. Therefore, in the case where the data receiving section of the column driving unit is in an abnormal state by noise, etc. and cannot normally receive data, the state of the column driving unit is transmitted to a timing controller, and the transmission of a clock training signal is requested, by which the data receiving section can normally receive data.

Although preferred embodiments of the present invention have been described for illustrative purposes, those skilled in the art will appreciate that various modifications, additions and substitutions are possible, without departing from the scope and the spirit of the invention as disclosed in the accompanying claims.

What is claimed is:

1. A display driving system comprising:

a timing controller comprising a receiving unit configured to receive data signals, a data processing unit configured to process and output the data signals, a clock generation unit configured to generate clock signals and timing control signals, and a transmission block configured to transmit the data signals, the clock signals, and the timing control signals; and a panel driving block comprising row driving units configured to sequentially scan gate signals to a display panel, and column driving units configured to receive the data signals transmitted from the transmission block through signal lines and drive the display panel, wherein the transmission block of the timing controller comprises driving units configured to output transmission data to the column driving units, wherein the driving units comprise a first driving unit, the column driving units comprise a first column driving unit, the signals lines comprise a first signal line, and the transmission data comprises first transmission data, and wherein the first driving unit is configured to output the first transmission data to the first column driving unit through the first signal line, wherein the first transmission data comprises clock training data during a clock training data transmission step, control data for controlling the column driving units during a control data transmission step, and RGB data during an RGB data transmission step, the clock training data comprising clocks used by the column driving units to synchronize internally recovered clock signals, wherein the first transmission data, during the control data transmission step, comprises the clock signals embedded between control data signals, such that amplitudes of the control data signals are the same as amplitudes of the clock signals, and wherein the first transmission data, during the control data transmission step, comprises a separate TR-bit for each word in the control data, each TR-bit comprising a first data bit in a given word, a value of each TR-bit is low for each continuous word of the control data, the value of the TR-bit is high for a final word of the control data, and the first transmission data transmitted after the final word comprise the RGB data.

2. The display driving system according to claim 1, wherein each clock signal is embedded for each data signal of one RGB pixel among the data signals.

3. The display driving system according to claim 1, wherein each clock signal is embedded for each data signal corresponding to one half of one RGB pixel among the data signals.

4. The display driving system according to claim 1, wherein each clock signal is embedded for each sub-pixel which constitutes the RGB pixel.

5. The display driving system according to claim 1, wherein the timing controller comprises:

the receiving unit configured to receive the data;

the data processing unit configured to temporarily store the received data and output the clock training data, the control data, and the RGB data depending upon a protocol;

the clock generation unit configured to generate the clock signals and the timing control signals; and the transmission block configured to receive the clock training data, the control data, and the RGB data which are outputted from the data processing unit, serialize these data in response to the clock signals which are outputted from the clock generation unit, and transmit the serialized data, the transmission block comprising:

a data distribution unit configured to receive the clock training data, the control data, and the RGB data which are outputted from the data processing unit, and distribute data to be transmitted to the column driving units;

parallel-to-serial conversion units configured to convert the distributed data into serial data in response to the clock signals; and the driving units configured to transmit data outputted from the parallel-to-serial conversion units to the column driving units.

6. The display driving system according to claim 1, wherein, when the value of a second TR-bit is a low value, the length of the control data transmission step is extended to at least three words, and when the value of the second TR-bit is a high value, the length of the control data transmission step is not extended to three words and a current word is recognized as the final word in the control data transmission step.

7. The display driving system according to claim 1, wherein the timing controller is configured to additionally serialize a clock signal and a dummy signal in order to indicate transition timing (a rising edge or a falling edge) of the clock signal embedded between the clock training data, the control data, and the RGB data.

8. The display driving system according to claim 7, wherein the dummy signal and the clock signal can be changed in signal width.

9. The display driving system according to claim 1, wherein a first TR-bit distinguishes the clock training data transmission step and the control data transmission step.

10. The display driving system according to claim 9, wherein the first TR-bit is configured by combining one or more data bits.

11. The display driving system according to claim 1, wherein the column driving units are configured to output LOCK signals($LOCK_1$ ~$LOCK_{N-1}$) in a logic high state sequentially to adjacent column driving units when received clock signals, which are synchronized with the clock training data inputted from the timing controller, are stabilized, and a final column driving unit is configured to transfer a logic high state of a $LOCK_N$ signal to the timing controller, and wherein the timing controller is configured to end the clock training data transmission step and start transmission of clock-embedded data signals after a predetermined time elapses.

12. The display driving system according to claim 11, wherein the timing controller is configured to end transmission of the clock training data and sequentially start the control data transmission step and the RGB data transmission step after the predetermined time elapses if the $LOCK_N$ signal received from the final column driving unit in the clock training data transmission step changes to the logic high state, and wherein the timing controller is configured to transmit again the clock training data until the predetermined time elapses after the $LOCK_N$ signal changes to the logic high state, if the $LOCK_N$ signal changes to a logic low state while transmitting the data from the column driving units.

13. The display driving system according to claim 1, wherein the first column driving unit comprises:

a data receiving section configured to receive clock-embedded data transmitted from the timing controller;

a data latch configured to sequentially store RGB data depending upon control information included in the data received by the data receiving section; and a digital-to-analog converter configured to drive a panel depending upon values of the RGB data stored in the data latch.

14. The display driving system according to claim 13, wherein the data receiving section comprises:

a clock recovery part configured to recover received clock signals for data sampling; and a serial-to-parallel conversion part configured to sample and output the control data and the RGB data included in the first transmission data at transition timing (rising edges or falling edges) of the received clock signals.

15. The display driving system according to claim 14, wherein the data receiving section is configured to recognize the control data transmission step depending upon a first TR-bit transmitted after an embedded clock signal of first control data transmitted after the clock training data transmission step is ended, by using the received clock signals which are stabilized during the clock training data transmission step, and wherein the data receiving section is configured to recognize the RGB data transmission step from a data word transmitted thereafter, and receive the control data and the RGB data by classifying received signals.

16. The display driving system according to claim 14, wherein the data receiving section is configured to distinguish first control data or final control data depending upon a value of a TR-bit inserted in each control data word when at least one control data word is transmitted during the control data transmission step, and recognize data transmitted thereafter as the RGB data and sample the control data and the RGB data by classifying received signals.

17. The display driving system according to claim 14, wherein the first column driving unit is configured to determine timing at which the RGB data transmission step is ended, by counting a word number of the inputted RGB data on the basis of a predetermined word number of the RGB data, and the RGB data transmission step is ended, in such a manner that whether a next clock training data transmission step is started is determined.

18. The display driving system according to claim 14, wherein the clock recovery part is configured to ease recovery of the received clock signals by using the clock training data transmitted from the transmission block, and to stabilize the recovered received clock signals.

19. The display driving system according to claim 18, wherein the received clock signals comprise multi-phase clock signals which have the same frequency as the clock signals embedded between the clock training data and the RGB data.

* * * * *